US009365795B2

(12) United States Patent
Gauthier et al.

(10) Patent No.: US 9,365,795 B2
(45) Date of Patent: Jun. 14, 2016

(54) ANTIFOAM ADDITIVES FOR USE IN LOW VISCOSITY APPLICATIONS

(71) Applicant: Afton Chemical Corporation, Richmond, VA (US)

(72) Inventors: Diane Gauthier, Richmond, VA (US); Joseph B. Carroll, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 356 days.

(21) Appl. No.: 13/974,370

(22) Filed: Aug. 23, 2013

(65) Prior Publication Data

US 2014/0073542 A1 Mar. 13, 2014

Related U.S. Application Data

(60) Provisional application No. 61/698,815, filed on Sep. 10, 2012.

(51) Int. Cl.

| | |
|---|---|
| ***C10M 163/00*** | (2006.01) |
| ***C10M 169/04*** | (2006.01) |
| ***C10M 115/08*** | (2006.01) |
| ***C10M 155/02*** | (2006.01) |

(52) U.S. Cl.

CPC ..... *C10M 155/02* (2013.01); *C10M 2229/047* (2013.01); *C10N 2220/021* (2013.01); *C10N 2220/022* (2013.01); *C10N 2230/18* (2013.01); *C10N 2240/04* (2013.01); *C10N 2240/042* (2013.01); *C10N 2240/044* (2013.01); *C10N 2240/045* (2013.01); *C10N 2240/10* (2013.01); *C10N 2240/105* (2013.01); *C10N 2240/106* (2013.01)

(58) Field of Classification Search

CPC ..... C10M 2227/061; C10M 2227/04; C10M 2229/041; C10M 2207/282

USPC ..... 508/185, 204, 208, 210–211, 214–215

See application file for complete search history.

(56) References Cited

U.S. PATENT DOCUMENTS

| | | | | |
|---|---|---|---|---|
| 5,372,735 | A * | 12/1994 | Ohtani | C10M 133/06 508/558 |
| 5,373,035 | A | 12/1994 | Uemura et al. | |
| 6,391,831 | B1 | 5/2002 | Ebbrecht et al. | |

FOREIGN PATENT DOCUMENTS

| | | | |
|---|---|---|---|
| CN | 1637127 | A | 7/2005 |
| DE | 213945 | A | 9/1984 |
| JP | 11209778 | A | 8/1999 |
| JP | 2005-162883 | A1 | 6/2005 |

OTHER PUBLICATIONS

Japanese Certified Final Decision for Rejection; Mailed Jun. 3, 2015 for the corresponding JP Application No. JP2013-184885.

European Search Report: Mailed Jan. 3, 2014 for the corresponding EP Application No. EP13183640.5.

European Office Action: Mailed Feb. 6, 2015 for the corresponding EP Application No. EP13183640.5.

Korean Notice for Grounds for Rejection; Mailed: Mar. 24, 2015 for the corresponding KR Application No. 2013-0107523.

European Office Action: Mailed Jul. 23, 2015 for the EP Application No. 13183640.5.

Chinese Office Action; Mailed Oct. 22, 2014 for corresponding CN Application No. CN201310491437.5.

Gruning, B., "Chemie und Technologie der Siliconetenside", Bayer AG, Th. Goldschmidt AG, Wacker-Chemie GmbH: "Silicone Chemie und Technologie", Apr. 28, 1989, Vulkan Verlag, Essen, pp. 116-123. (See European Search Report filed in Jul. 17, 2015 IDS.).

3rd. Party Observation Conducted by Evonik Degussa GmbH; Mailed on Jul. 29, 2015 for EP Application No. EP13183640.5 (see Statement of Relevance).

* cited by examiner

*Primary Examiner* — Vishal Vasisth

(74) *Attorney, Agent, or Firm* — Mendelsohn Dunleavy, P.C.

(57) ABSTRACT

A lubricant composition comprising a major amount of a base oil having a kinematic viscosity between 2 and 8 cSt at 100° C. and a minor amount of an additive composition represented by formula IV:

IV

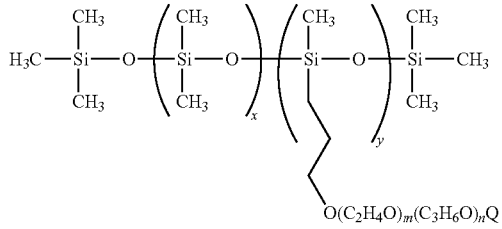

wherein x and y can be the same or different and (x+y) equals between 50 and 1,500 and m and n can be the same or different and Q is hydrogen or a monovalent organic group selected from the group consisting of C1-C8 alkyl, acetyl and isocyanato group of the formula —NCO.

26 Claims, No Drawings

ANTIFOAM ADDITIVES FOR USE IN LOW VISCOSITY APPLICATIONS

RELATED APPLICATIONS

This application is a non-provisional application of application Ser. No. 61/698,815, filed Sep. 10, 2012.

TECHNICAL FIELD

The disclosure relates to the field of anti-foam additives for use in lubricants and in particular for anti-foam additives for use in automatic transmission fluids having a low kinematic viscosity.

BACKGROUND AND SUMMARY

Automotive driveline systems include complex gear trains and turbomachinery that rely on petroleum products to provide a hydraulic working fluid and lubricant. Specifically, passenger car automatic transmissions and transaxles use turbines, pumps, gears and clutches operating at high speed and high temperature in a lubricant. The high speed rotation and high power densities of these systems, combined with the air space in the system and air entrained in the lubricant, may result in the formation of foam. Foam, consisting of a small quantity of lubricant and a large quantity of air, compromises pump efficiencies by changing the compressibility of the lubricant. As a result, pistons and valves actuated by the lubricant may not function correctly if the air content of the working fluid is large. Furthermore, the gear trains may receive inadequate lubrication, due to low pump efficiencies and a reduced capacity for the lubricant to provide a cooling effect, if a foam condition exists. Modern designs of drivetrain hardware are trending towards small sumps and higher power throughput densities, and relying upon less lubricant in general than prior designs. A lower lubricant volume may compound the challenge of dispelling foam from drivetrain system under operating conditions over a period of time. These foaming issues are exacerbated when the lubricant has a low viscosity because the typical chemistry used as antifoam additives is unable to stay suspended making "drop out" a concern. Because driveline system lubricants are moving to lower and lower viscosities to try and make gains in fuel economy the problems associated with foaming have increased.

The present invention addresses the problems of foaming in low viscosity lubricants by introducing unique antifoam chemistry that is capable of remaining suspended in lubricant formulations even when the lubricant has kinematic viscosities as low as 2-8 cSt or even 2-5 cSt at 100° C.

In one embodiment, the invention relates to a lubricant composition comprising a base oil having a kinematic viscosity between 2 and 8 cSt at 100° C., or alternatively between 2 and 6 cSt at 100° C., or in a further alternative between 2 and 5 or between 2 and 4.5 cSt at 100° C.; and an additive composition represented by formula I:

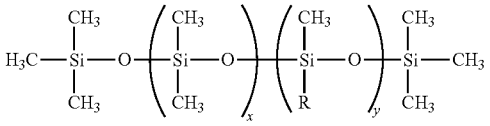

I wherein x and y can be the same or different and (x+y) equals between 50 and 1,500 and R is a polyoxyalkylene group. Generally, according to the present invention, the base oil is present in a major amount whereas the additive composition of the invention is present in a minor amount. It is to be understood that according to the invention, a "major amount" is greater than "a minor amount". In a particular embodiment, a "major amount" relates to at least 50 weight-% of the composition. In an alternative embodiment, the term "a major amount" relates to at least 70, or at least 80, or at least 90 or even at least 98 weight-% of the composition. In one embodiment, R has a molecular weight of 500-5000 g/mol.

In one embodiment, said minor amount of an additive composition delivers between 2 and 500 ppm of silicon to the lubricant composition.

In another embodiment, a lubricant composition may comprise an additive composition represented by formula I wherein x is between 100 and 300 and y is between 10 and 20.

In yet another embodiment, a lubricant composition may comprise an additive composition represented by formula I wherein x is between 160 and 190 and y is between 14 and 18.

In yet another embodiment, a lubricant composition may comprise an additive composition represented by formula I wherein R is represented by formula II:

$$—(CH_2)_a—O—(R_1)_b\text{-}Q \qquad \text{II}$$

and $R_1$ is a combination of ethylene oxide and propylene oxide units, Q is hydrogen or a monovalent organic group selected from the group consisting of C1-C8 alkyl, acetyl and isocyanato group of the formula —NCO, subscript a is a positive integer of 2-6 and subscript b is a positive integer of 5-100.

In still another embodiment a lubricant composition may comprise an additive composition represented by formula 1 wherein R is represented by formula II and wherein subscript a is a positive integer of 2-6 and subscript b is a positive integer of 20-70.

In still another embodiment a lubricant composition may comprise an additive composition represented by formula I wherein R is represented by formula II and wherein subscript a is a positive integer of 2-6 and subscript b is a positive integer of 25-45.

In one embodiment, a lubricant composition may comprise an additive composition represented by formula I wherein R is represented by formula II and wherein $R_1$ is represented by formulas III:

$$(C_2H_4O)_m(C_3H_6O)_n \text{ or } (C_3H_6O)_n(C_2H_4O)_m \qquad \text{III}$$

and wherein m is a positive integer of 1-10 and n is a positive integer of 5-50.

In another embodiment, a lubricant composition may comprise an additive composition represented by formula I wherein R is represented by formula II and wherein $R_1$ is represented by formulas III and wherein m is a positive integer of 3-6 and n is a positive integer of 20-40.

In still another embodiment, a lubricant composition may comprise an additive composition represented by formula I wherein R is represented by formula II and wherein $R_1$ is represented by formulas III and formula III is a polymer selected from the group consisting of a random copolymer or a block copolymer.

In another embodiment, a lubricant composition may comprise a base oil having a kinematic viscosity between 2 and 8 cSt at 100° C., or in another embodiment between 2 and 6 cSt at 100° C., or in yet another embodiment between 2 and 5 or between 2 and 4.5 cSt at 100° C., and an additive composition represented by formula IV:

IV

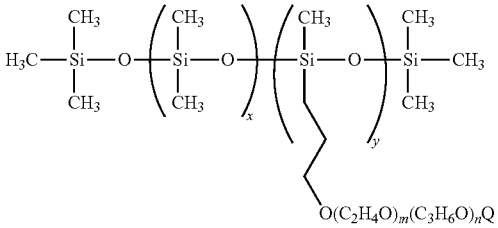

wherein x and y can be the same or different and (x+y) equals between 50 and 1,500 and m and n can be the same or different and Q is hydrogen or a monovalent organic group selected from the group consisting of C1-C8 alkyl, acetyl and isocyanato group of the formula —NCO. As stated above, generally, according to the present invention, the base oil is present in a major amount whereas the additive composition of the invention is present in a minor amount. It is to be understood that according to the invention, a "major amount" is greater than "a minor amount". In a particular embodiment, a "major amount" relates to at least 50 weight-% of the composition. In an alternative embodiment, the term "a major amount" relates to at least 70, or at least 80, or at least 90, or at least 98 weight-% of the composition.

In another embodiment a lubricant composition may comprise an additive composition represented by formula IV wherein x is between 160 and 190 and y is between 14 and 18, m is a positive integer of 3-6 and n is a positive integer of 20-40, and Q is hydrogen or methyl.

In another embodiment a lubricant composition may comprise an additive composition represented by formula I wherein said additive composition delivers between 2 and 50 ppm of silicon to the lubricant composition.

In another embodiment a lubricant composition may comprise an additive composition represented by formula I wherein said additive composition delivers between 2 and 25 ppm of silicon to the lubricant composition.

In another embodiment a lubricant composition of the invention may comprise a base oil having a kinematic viscosity between 2 and 6 cSt at 100° C., or alternatively between 2 and 4.5 cSt at 100° C.

In yet another embodiment a lubricant composition of the invention may further comprise an oil-soluble ashless dispersant selected from the group consisting of: a succinimide dispersant, a succinic ester dispersant, a succininic ester-amide dispersant, a Mannich base dispersant, phosphorylated, boronated or phosphorylated and boronated forms thereof.

In yet another embodiment of the invention, a lubricant composition may further comprise one or more of the following: an air expulsion additive, an antioxidant, a corrosion inhibitor, a foam inhibitor, a metallic detergent, an organic phosphorus compound, a seal-swell agent, a viscosity index improver, and an extreme pressure additive.

In still another embodiment the invention includes a method of lubricating a machine part comprising lubricating the machine part with a lubricant composition comprising a minor amount of an additive composition of the invention.

In another embodiment, the invention includes a method wherein the minor amount of an additive composition delivers between 2 and 500 ppm of silicon to the lubricant composition.

In another embodiment, the invention includes a method wherein the machine part comprises a gear, an axle, a differential, an engine, a crankshaft, a transmission, or a clutch.

In another embodiment, the invention includes a method wherein the transmission is selected from the group consisting of an automatic transmission, a manual transmission, an automated manual transmission, a semi-automatic transmission, a dual clutch transmission, a continuously variable transmission, and a toroidal transmission.

In another embodiment, the invention includes a method wherein the clutch comprises a continuously slipping torque converter clutch, a slipping torque converter clutch, a lock-up torque converter clutch, a starting clutch, one or more shifting clutches, or an electronically controlled converter clutch.

In another embodiment, the invention includes a method wherein the gear is selected from the group consisting of an automotive gear, a stationary gearbox, and an axle.

In another embodiment, the invention includes a method wherein the gear is selected from the group consisting of a hypoid gear, a spur gear, a helical gear, a bevel gear, a worm gear, a rack and pinion gear, a planetary gear set, and an involute gear.

In another embodiment, the invention includes a method wherein the differential is selected from the group consisting of a straight differential, a turning differential, a limited slip differential, a clutch-type limited slip differential, and a locking differential.

In another embodiment, the invention includes a method wherein the engine is selected from the group consisting of an internal combustion engine, a rotary engine, a gas turbine engine, a four-stroke engine, and a two-stroke engine.

In another embodiment, the invention includes a method wherein the engine comprises a piston, a bearing, a crankshaft, and/or a camshaft.

In another embodiment, the invention includes a method for improving the antifoam properties of a lubricating fluid comprising an additive composition of the invention. In particular, the additive composition of the invention can be used to improve the antifoam properties of a lubricating fluid having a kinematic viscosity of between 2-8 cSt at 100 C, or alternatively between 2 and 6 cSt at 100° C., or in a further alternative between 2 and 5 or 2 and 4.5 cSt at 100° C.

In one embodiment the invention therefore includes a method for improving the antifoam properties of a lubricating fluid having a kinematic viscosity of between 2-8 cSt at 100 C, or alternatively between 2 and 6 cSt at 100° C., or in a further alternative between 2 and 5 or 2 and 4.5 cSt at 100° C., comprising including in a lubricating fluid an effective amount of one or more compounds of formula I

I

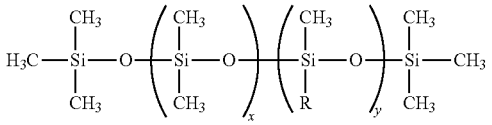

wherein x and y can be the same or different and (x+y) equals between 50 and 1,500 and R is a polyoxyalkylene group. In one embodiment, R has a molecular weight of 500-5000 g/mol.

In another embodiment the invention includes a method for improving the antifoam properties of a lubricating fluid having a kinematic viscosity of between 2-8 cSt at 100 C, or alternatively between 2 and 6 cSt at 100° C., or in a further alternative between 2 and 5 or 2 and 4.5 cSt at 100° C., comprising including in a lubricating fluid an effective amount of one or more compounds of formula IV

IV

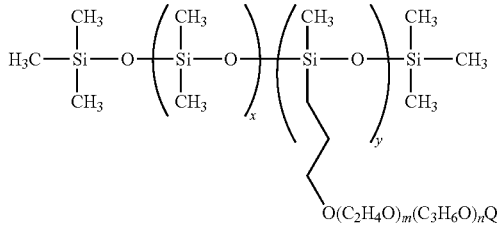

wherein x and y can be the same or different and (x+y) equals between 50 and 1,500 and m and n can be the same or different and Q is hydrogen or a monovalent organic group selected from the group consisting of C1-C8 alkyl, acetyl and isocyanato group of the formula —NCO.

In one embodiment, an effective amount of one or more compounds of formula I or IV delivers between 2 and 500 ppm of silicon to the lubricant composition. In alternative embodiments, an effective amount of one or more compounds of formula I or IV delivers between 2 and 50 ppm or between 2 and 25 ppm of silicon to the lubricant composition.

In another embodiment the invention includes a method for improving the antifoam properties of a lubricating fluid having a kinematic viscosity of between 2-8 cSt at 100° C., comprising including in a lubricating fluid an effective amount of one or more compounds of formula IV wherein x is between 160 and 190 and y is between 14 and 18 and m is a positive integer of 3-6 and n is a positive integer of 20-40, and Q is hydrogen or methyl.

In still another embodiment the invention includes a method for improving the antifoam properties of a lubricating fluid while lubricating an automotive component requiring lubrication, comprising adding a lubricating fluid to an automotive component requiring lubrication, the fluid comprising a base oil having a kinematic viscosity at between 2 and 5 cSt at 100° C., and one or more compounds of formula IV

IV

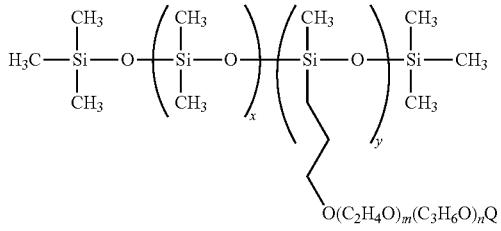

wherein x and y can be the same or different and (x+y) equals between 50 and 1,500 and m and n can be the same or different and Q is hydrogen or a monovalent organic group selected from the group consisting of C1-C8 alkyl, acetyl and isocyanato group of the formula —NCO and operating the automotive component that contains the fluid, wherein the antifoam performance of the fluid is improved relative to the performance of a lubricating fluid free of the compound of formula IV.

In still another embodiment the invention includes a method for improving the antifoam properties of a lubricating fluid while lubricating an automotive component requiring lubrication, comprising adding a lubricating fluid to an automotive component requiring lubrication, the fluid comprising a base oil having a kinematic viscosity at between 2 and 6 cSt at 100° C., or alternatively between 2 and 5 cSt at 100° C., or in a further alternative between 2 and 4.5 cSt at 100° C., and one or more compounds of formula IV wherein x is between 160 and 190 and y is between 14 and 18, m is a positive integer of 3-6 and n is a positive integer of 20-40, and Q is hydrogen or methyl.

In still another embodiment the invention includes a method for improving the antifoam properties of a lubricating fluid while lubricating an automotive component requiring lubrication, comprising adding a lubricating fluid to an automotive component requiring lubrication, the fluid comprising a base oil having a kinematic viscosity at between 2 and 5 cSt at 100° C., and one or more compounds of formula IV wherein x is between 160 and 190 and y is between 14 and 18, m is a positive integer of 3-6 and n is a positive integer of 20-40, and Q is hydrogen or methyl and the one or more compounds of formula IV is present in an amount capable of delivering between 2 and 50 ppm of silicon to the lubricating fluid.

DETAILED DESCRIPTION

An example of the present invention and certain comparative examples are provided below. All the examples were tested for antifoam performance using a low viscosity Group III mineral base oil. However, other low viscosity base oils could have been used including base oils from Groups I, II and IV.

EXAMPLES

All the examples, Examples 1-4, are finished automatic transmission fluids containing identical additive packages, using typical automatic transmission fluid componentry, e.g., dispersant, detergent, friction modifiers, antioxidants, etc. All the Examples were blended at similar treat rates into the same base stock, a Group III mineral oil having a kinematic viscosity of 4.5 cSt at 100° C. The essential difference in the Examples was the choice of antifoam additive. The various antifoam additives used are described more fully below and are typically prepared by a known method involving the addition reaction of so-called hydrosilation. For example, a methyl hydrogen polysiloxane having hydrogen atoms directly bonded to the silicon atoms is subjected to the hydrosilation reaction with a polyoxyalkylene compound having a vinyl or allyl group at a molecular chain end in the presence of a catalytic amount of a platinum catalyst. Comparative Example 2 is a commercially available polydimethyl siloxane with no substitution.

Example 1

Example 1 contained a polymeric nonionic silicone surfactant consisting of a polydimethylsiloxane backbone with graft polyoxyalkylene chains, Antifoam A. Antifoam A was treated at 5 ppm (80 ppm on a solids basis of Antifoam A) of silicon in the finished lubricant Example 1. Inductively Coupled plasma mass spectrometry (ICP) was used to obtain the silicon content in Example 1 and all other Examples. Antifoam A is represented in Table 1, Figure IV wherein variable x is 176.5 and y is 15.8. The variable m is 4.4 and n is 28.6. The molecular weight (Mw) is 44,078.

The Mw of Antifoam A was calculated as described below using GPC analysis. This molecular weight was used along with $^{13}C$ NMR data to elucidate the values for x, y, m and n in Figure IV of Table 1. The integration of the peak at 12.5 ppm, representing the methylene of the polyoxyalkylene side chain attached to the PDMS backbone, was assigned the value of 1. All other $^{13}C$ NMR peak areas were normalized accordingly. The $^{13}C$ NMR chemical shift scale was referenced to $CDCl_3$ $\delta_c$=77.0 ppm.

The integration of the peaks from −2 to 2 ppm, assigned to the PDMS methyls, were used to determine the total number of carbons in the PDMS backbone. Because we know that this integration included the methyl groups of the y unit, we took the integration of the peak at 12.5 ppm and subtracted it from the total integration from −2 to 2 ppm to provide a new integration value that is representative of only those carbons that are from unit x and the two terminal silicon end groups. Because every x repeat unit has two methyl groups, the new integration value was further divided by two. In addition, because the carbons from the end groups are only a minor contributor to the −2 to 2 ppm integration value their contribution to the −2 to 2 ppm integration value was disregarded. After these calculations are performed this integration value, representing the carbons from the x repeat unit, can be compared to the normalized value at 12.5 ppm and a ratio of the carbons from repeat unit x and repeat unit y can be calculated. For Antifoam A the ratio of x to y was 11.2 to 1.

In order to calculate the actual number of x and y repeat units the values of m and n need to be determined. The integration of the peaks from 15.5 to 17.1 ppm, representing the methyl group carbons of propylene oxide, yields the n value of the propylene oxide repeat units within the polyoxyalkylene chain. For Antifoam A, n is 28.6. The integration of the peaks from 69 to 75 ppm represent the two methylene carbons associated with the PEO and the methine and methylene carbons of PPO. Because of peak overlap, the amount of EO is determined by subtracting twice the integration of the methyl PPO carbon at 15.5 to 17.1 ppm (substituting for the methine and methylene PPO integrations) from the overall integration of the peaks from 69 to 75 ppm, which provides the m value of the ethylene oxide repeat units within the polyoxyalkylene chain. The m value for Antifoam A is 4.4.

Once the values of m and n are determined the molecular weight of repeat unit y can be calculated. In the case of Antifoam A the molecular weight of the y repeat unit was 1,958 g/mol. The molecular weight of the x repeat unit is 74 g/mol. One end of Antifoam A ($OSi(CH_3)_3$) has a molecular weight of 89 g/mol and the opposite end of Antifoam A ($Si(CH_3)_3$) has a molecular weight of 78 g/mol. Knowing the molar ratio of the repeat units x and y, the molecular weight of repeat units x and y and the total molecular weight of Antifoam A, as determined by GPC, the absolute number of x and y repeat units can be calculated. For example the total molecular weight of Antifoam A is 44,078 g/mol, with the end caps removed 43,911 g/mol (44,078−89−78=43,911).

$$43{,}911\ \text{g/mol}=11.2(74X)+1(1958X)$$

Solving for X we get 15.8. 15.8 represents the number of y repeat units and 11.2 (15.8) yields the number of x repeat units (176.5).

Example 2

Example 2 is identical to Example 1 except the treat rate of Antifoam A was increased to (160 ppm of Antifoam A on a solids basis) and 12 ppm of silicon in the lubricant composition.

Comparative Example 1

Comparative Example 1 contained a commercially available antifoam additive MASIL P280 available from Emerald Performance Materials treated at 12 ppm 485 ppm on a solids basis of silicon in the finished automatic transmission fluid. MASIL P280 is described by the manufacturer as a polymeric nonionic silicone surfactant consisting of a polydimethylsiloxane backbone with graft polyoxyalkylene hydrophiles. The molecular weight and the values for x, y, m and n were determined as described above for Example 1 and the results are listed in Table 1.

Comparative Example 2

Comparative Example 2 contained a commercially available antifoam additive DOW CORNING 200 FLUID 60,000 cSt available from Dow Corning. The neat antifoam is diluted to 4% solids in kerosene prior to use. The diluted antifoam is treated at 10 ppm (20 ppm on a solids basis) of silicon in the finished automatic transmission fluid. DOW CORNING 200 FLUID 60,000 cSt is an unfunctionalized polydimethylsiloxane. The molecular weight was determined as described above and the value for x was calculated based on the molecular weight. Y, m and n are not present in Comparative Example 2 because it is an unfunctionalized polydimethylsiloxane.

Comparative Example 3

Comparative Example 3 is identical to Comparative Example 1 except the MASILP280 is treated at 4 ppm (160 ppm on a solids basis) of silicon in the finished automatic transmission fluid.

Comparative Example 4

Comparative Example 4 is identical to Comparative Example 2 except the DOW CORNING 200 FLUID 60,000 cSt is treated at 80 ppm (160 ppm on a solids basis) of silicon in the finished automatic transmission fluid.

Molecular Weight and Number Average Molecular Weight Calculations for Antifoam Additives The molecular weights and number average molecular weights of the various antifoam additives were confirmed using gel permeation chromatography (GPC) with a polystyrene standard, e.g., PSS (Polymer Standards Service) Ready-Cal-Kit Polystryrene, for calibration. Samples and standards were prepared at 0.1-0.5% (w/v) in tetrahydrofuran. A set of columns whose matrix is highly cross-linked polystyrene/divinylbenzene was employed with a refractive index (RI) detector, and the samples were eluted with THF. The suggested molecular weight standard curve range for the polystyrene (PS) standards is approximately 500 to 377,000. A High Performance Liquid Chromatography (HPLC) or High Performance Gel Permeation Chromatography (HPGPC) system was used. Each system would use a high performance pump capable of a constant flow (nominal 1 ml/min.), an injector or auto-sampler, column heater to maintain a constant temperature, GPC column set (a series of columns: mixed bed or assorted pore size columns selected provide separation over the molecular range of interest), a Differential Refractive index detector and a chromatography software package for data collection and processing. The use of alternative detectors such as an ultraviolet detector may also be included in the system. A solvent degasser may also be connected to improve the baseline. The column used was a Varian Mixed C 300×7.8 mm (at least 2 in series) or equivalent. The instrument conditions were, Flow rate: 1.0 mL/min; *Detectors: RI (Refractive index) UV absorbance at 254 nm (optional); Injection Volume: 100 μL; Run Time: 30 min. (if using 3 columns) 15 min per column; Mobile Phase: THF un-stabilized; Column: Varian (now Agilent) PLgel 5 um Mixed-C, 300×7.5 mm (At least 2 in series) or equivalent; Column storage: THF, stabilized (long term); Column Heater: approximately 40° C. The chromatography system must be fully equilibrated before running any samples or standards. Calibration standards must be run every time samples are run. The standards are run before and after the samples and in between samples if more than 10-12 samples are run in the same sequence. Chromatographic data is acquired and processed on a chromatographic system capable of calculating GPC data such as Waters Empower System.

$$\text{Log MW}=D0+D1(\text{RT})+D2(\text{RT})+D3(\text{RT})+D4(\text{RT})$$

In the expression above "RT" is retention time and D0, D1, D2, D3, D4 are the exponents. Results are reported as the weight averaged molecular weight (Mw) to the nearest whole number and the number averaged molecular weight (Mn) to nearest whole number.

Testing

All the Examples were tested for anti-foam stability performance using a conventional anti-foam test method characterized in ASTM test procedure ASTM D892 D892 (SEQ III). The Examples were tested again using the same SEQ III procedure after the Examples were aged for two (2) weeks at ambient room temperature and pressure. The Examples were also undisturbed, i.e., no mixing or shaking over the 2 week period.

desirable level of antifoam performance. For example, GM's DEXRON-VI specifies that all DEXRON-VI formulations must exhibit antifoam efficacy of ≤50 ml foam in ATSM D892 Sequences I through III to meet their specification. Turning to Comparative Example 1, despite a comparable molecular weight (48,870 g/mol vs. 44,078 g/mol in Antifoam A), a higher graft density (1:9.4 vs. 1:11.2 for Antifoam A (# of graft side chains (y units): # dimethylsiloxane repeat units (x units))), and higher molecular weight polyalkylene side chains (~3000 g/mol vs. ~2000 g/mol for Antifoam A), the MASIL P280 antifoam falls short in ASTM D892 foam performance even at higher treat levels than Antifoam A. Despite having all of the benefits described previously (i.e higher graft side chains per PDMS backbone, higher Mw side chains, higher treat rate), because the ratio of polyethylene oxide to polypropylene oxide (m/n=19/33) is higher, in turn rendering the resulting antifoam more hydrophilic in character, MASIL P280 struggles to remain dispersible, soluble and stable in a hydrophobic (oil), low viscosity environment. The poor antifoam performance of MASIL P280 in Comparative Example 1 can be seen in the large foaming tendencies observed in SEQ III of the ASTM D892 testing. Likewise, in Comparative Example 2, pure PDMS, which has been used for decades as the antifoam choice in systems with kinematic viscosities >8 cSt, exhibited extremely poor ASTM D892 antifoam performance, particularly in SEQ III. Despite a long history as an effective antifoam additive, the antifoam performance of PDMS alone in low viscosity, oil systems suffers dramatically. Because of the absence of polyalkylene side chain functionality with unique ratios of polyethylene oxide to

TABLE 1

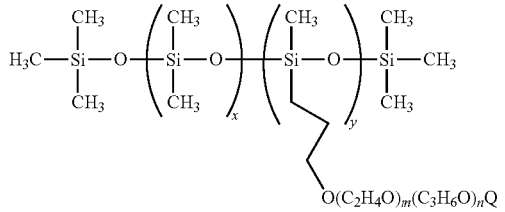

| IV | x | y | m | n | MW | Mn | Foam Test ASTM D892 SEQ III (fresh) (ml) | Foam Test ASTM D892 SEQ III (aged) (ml) |
|---|---|---|---|---|---|---|---|---|
| Example 1 | 176.5 | 15.8 | 4.4 | 28.6 | 44078 | 23683 | 30 | na |
| Example 2 | 176.5 | 15.8 | 4.4 | 28.6 | 44078 | 23683 | 0 | 5 |
| Comparative Example 1 | 129 | 13.7 | 19 | 33 | 48870 | 33012 | 260 | na |
| Comparative Example 2 | 1318 | 0 | 0 | 0 | 145580 | 97712 | 270 | na |
| Comparative Example 3 | 129 | 13.7 | 19 | 33 | 48870 | 33012 | 105 | 340 |

Table 1 above demonstrates the advantages of using optimized Antifoam A in Example 1. Antifoam A contains graft polyalkylene side chain functionality with unique ratios of polyethylene oxide to polypropylene oxide (m/n=4.4/28.6). These predominately PPO heavy polyalkylene side chains with calculated molecular weights of ~2000 g/mol per chain provide optimum dispersibility, solubility, and overall stability in low viscosity oil systems (results in Table 1 were all conducted at 4.5 cSt.) at a graft density of 1:11.2 (# of graft side chains (y units): # dimethylsiloxane repeat units (x units)). Antifoam A possesses not only the requisite physical/chemical properties to both remain well-dispersed and stable in solution at low viscosities but it also provides excellent antifoam performance as indicated by the low foaming tendencies observed in ASTM D892 foam testing. As shown in Table 1, Example 1 which contains Antifoam A, has SEQ III ml foam results comfortably below 50 ml (30) which is a polypropylene oxide to improve compatibility, solubility, and dispersibility, the lack of antifoam performance exhibited from PDMS in Comparative Example 2 is not unexpected. In higher viscosity oil systems (>6.0 cSt) antifoams with poor compatibility and solubility with their environment can remain relatively well-dispersed aided solely from antifoam density and oil viscosity tradeoffs (Stokes Law). However, as the viscosity drops (<6.0 cSt.), antifoams which do not contain side chains (PDMS in Comparative 2) or whose side chain functionality has not been carefully matched (i.e. optimum m/n, MASIL P280 in Comparative 1) with its non-polar, low viscosity environment can settle out of the oil system and stop functioning as an effective antifoam.

Example 2 and Comparative Examples 3 and 4 use the same antifoams as Examples 1 and Comparative Examples 1 and 2 respectively. However, the treat rates of each antifoam have been normalized to 160 ppm on a solids basis in the transmission fluid. The antifoam performance was consistent in ASTM D892 SEQ III foam testing using fresh blends of the antifoams in transmission fluids. Again, Antifoam A of Example 2 was superior to both MASIL P280 and PDMS. In addition, these samples were aged for 2 weeks and tested again in the SEQ III test and while all the fluids suffered a decrease in antifoam performance, Example 2 was able to maintain a foam tendency level well-below 50 ml in the SEQ III test while Comparative Examples 3 and 4 exhibited a foam tendency level above 50 ml indicating that Antifoam A was not only better at initial foam performance but was also more durable than the other commercially available alternatives.

Other embodiments of the present invention will be apparent to those skilled in the art from consideration of the specification and practice of the invention disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification and claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. It is intended that the specification and examples be considered as exemplary only, with a true scope and spirit of the invention being indicated by the following claims.

What is claimed is:

1. A lubricant composition comprising:

a) a major amount of a base oil having a kinematic viscosity between 2 and 8 cSt at 100° C.; and b) a minor amount of an additive composition represented by formula I:

I

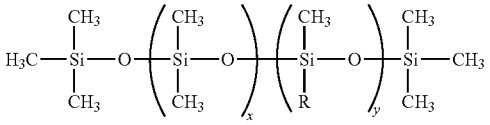

wherein x and y can be the same or different and (x+y) equals between 50 and 1,500 and R is a polyoxyalkylene group having a molecular weight of 500-5000 g/mol and is represented by the following formula:

$$—(CH_2)_a—O—(C_2H_4O)_m(C_3H_6O)_n\text{-}Q$$

Q is hydrogen or a monovalent organic group selected from the group consisting of C1-C8 alkyl, acetyl and isocyanato group of the formula —NCO, subscript a is a positive integer of 2-6, m is a positive integer of 3-6 and n is a positive integer of 20-40.

2. The lubricant composition of claim 1 wherein x is between 100 and 300 and y is between 10 and 20.

3. The lubricant composition of claim 1 wherein subscript a is a positive integer of 2-3.

4. The lubricant composition of claim 1 wherein the $—(C_2H_4O)_m(C_3H_6O)_n—$ group forms a random copolymer or a block copolymer.

5. A lubricant composition comprising:

a) a major amount of a base oil having a kinematic viscosity between 2 and 8 cSt at 100° C.; and b) a minor amount of an additive composition represented by formula IV:

IV

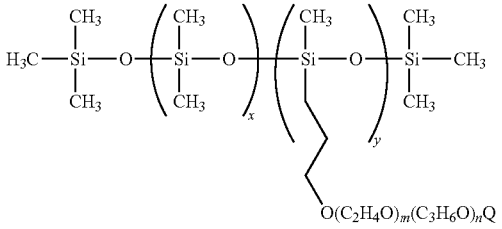

wherein x and y can be the same or different and (x+y) equals between 50 and 1,500 and m and n can be the same or different and m is a positive integer of 3-6 and n is a positive integer of 20-40 and Q is hydrogen or a monovalent organic group selected from the group consisting of C1-C8 alkyl, acetyl and isocyanato group of the formula —NCO.

6. The lubricant composition of claim 5 wherein x is between 160 and 190 and y is between 14 and 18, and Q is hydrogen or methyl.

7. The lubricant composition of claim 1, wherein said minor amount of an additive composition delivers between 2 and 50 ppm of silicon to the lubricant composition.

8. The lubricant composition of claim 5, wherein said minor amount of an additive composition delivers between 2 and 25 ppm of silicon to the lubricant composition.

9. The lubricant composition of claim 1 wherein the base oil has a kinematic viscosity between 2 and 6 cSt at 100° C.

10. The lubricant composition of claim 1, further comprising an oil-soluble ashless dispersant selected from the group consisting of: a succinimide dispersant, a succinic ester dispersant, a succininic ester-amide dispersant, a Mannich base dispersant, phosphorylated, boronated or phosphorylated and boronated forms thereof.

11. The lubricant composition of claim 1, further comprising one or more of the following: an air expulsion additive, an antioxidant, a corrosion inhibitor, a foam inhibitor, a metallic detergent, an organic phosphorus compound, a seal-swell agent, a viscosity index improver, and an extreme pressure additive.

12. A method of lubricating a machine part comprising lubricating said machine part with the lubricant composition of claim 1.

13. The method of claim 12, wherein said machine part comprises a gear, an axle, a differential, an engine, a crankshaft, a transmission, or a clutch.

14. The method of claim 13, wherein said transmission is selected from the group consisting of an automatic transmission, a manual transmission, an automated manual transmission, a semi-automatic transmission, a dual clutch transmission, a continuously variable transmission, and a toroidal transmission.

15. The method of claim 13, wherein said clutch comprises a continuously slipping torque converter clutch, a slipping torque converter clutch, a lock-up torque converter clutch, a starting clutch, one or more shifting clutches, or an electronically controlled converter clutch.

16. The method of claim 13, wherein said machine part is selected from the group consisting of an automotive gear, a stationary gearbox, and an axle.

17. The method of claim 13, wherein said gear is selected from the group consisting of a hypoid gear, a spur gear, a helical gear, a bevel gear, a worm gear, a rack and pinion gear, a planetary gear set, and an involute gear.

18. The method of claim 13, wherein said differential is selected from the group consisting of a straight differential, a turning differential, a limited slip differential, a clutch-type limited slip differential, and a locking differential.

19. The method of claim 13, wherein said engine is selected from the group consisting of an internal combustion engine, a rotary engine, a gas turbine engine, a four-stroke engine, and a two-stroke engine.

20. The method of claim 13, wherein said engine comprises a piston, a bearing, a crankshaft, and/or a camshaft.

21. A method for improving the antifoam properties of a lubricating fluid having a kinematic viscosity of between 2-8 cSt at 100° C., comprising including in a lubricating fluid an effective amount of one or more compounds of formula I

I

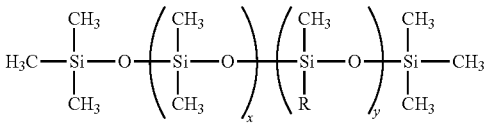

wherein x and y can be the same or different and (x+y) equals between 50 and 1,500 and R is a polyoxyalkylene group having a molecular weight of 500-5000 g/mol and is represented by the following formula:

$$—(CH_2)_a—O—(C_2H_4O)_m(C_3H_6O)_n\text{-}Q$$

Q is hydrogen or a monovalent organic group selected from the group consisting of C1-C8 alkyl, acetyl and isocyanato group of the formula —NCO, subscript a is a positive integer of 2-6, m is a positive integer of 3-6 and n is a positive integer of 20-40.

22. The method of claim 21 wherein the one or more compounds of formula I comprises one or more compounds of formula IV

IV

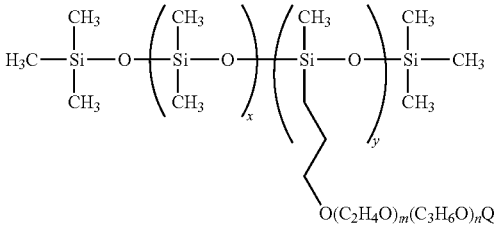

wherein x and y can be the same or different and (x+y) equals between 50 and 1,500 and m and n can be the same or different and m is a positive integer of 3-6 and n is a positive integer of 20-40 and Q is hydrogen or a monovalent organic group selected from the group consisting of C1-C8 alkyl, acetyl and isocyanato group of the formula —NCO.

23. The method of claim 21 wherein x is between 160 and 190 and y is between 14 and 18, and Q is hydrogen or methyl.

24. A method for improving the antifoam properties of a lubricating fluid while lubricating an automotive component requiring lubrication, comprising:

1) adding a lubricating fluid to an automotive component requiring lubrication, said fluid comprising (a) a base oil having a kinematic viscosity at between 2 and 5 cSt at 100° C., and (b) one or more compounds of formula IV

IV

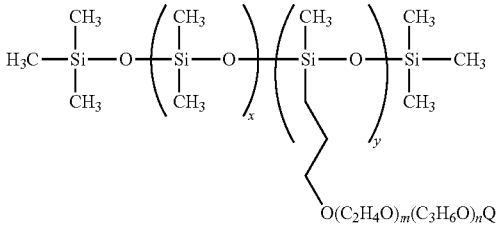

wherein x and y can be the same or different and (x+y) equals between 50 and 1,500 and m and n can be the same or different and m is a positive integer of 3-6 and n is a positive integer of 20-40 and Q is hydrogen or a monovalent organic group selected from the group consisting of C1-C8 alkyl, acetyl and isocyanato group of the formula —NCO; and 2) operating the automotive component that contains the fluid, wherein the antifoam performance of the fluid is improved relative to the performance of a lubricating fluid free of the compound of 1) (b).

25. The method of claim 24 wherein x is between 160 and 190 and y is between 14 and 18, and Q is hydrogen or methyl.

26. The method of claim 25, wherein said one or more compounds of claim 1 (b), is present in an amount capable of delivering between 2 and 50 ppm of silicon to the lubricating fluid.

* * * * *